United States Patent [19]

Neale

[11] Patent Number: 4,979,675

[45] Date of Patent: Dec. 25, 1990

[54] PRESSURE CONTROL VALVE

[75] Inventor: Antony J. Neale, Rochester, England

[73] Assignee: Lucas Industries Public Limited Company, Birmingham, England

[21] Appl. No.: 296,840

[22] Filed: Jan. 13, 1989

[30] Foreign Application Priority Data

Jan. 16, 1988 [GB] United Kingdom ..... 8800956
Jul. 21, 1988 [GB] United Kingdom ..... 8817466

[51] Int. Cl.[5] ..... F02M 55/02

[52] U.S. Cl. ..... 239/94; 239/533.3; 239/533.7; 239/533.9; 137/493.3; 137/493.6; 137/493.7

[58] Field of Search ..... 239/93, 94, 124, 126, 239/533.2, 533.3, 533.7–533.8; 123/460, 467; 137/493.3–493.7

[56] References Cited

U.S. PATENT DOCUMENTS 4,459,086 7/1984 Häfele et al. ..... 137/493.5 X
4,648,369 3/1987 Wannenwetsch ..... 137/493.3 X

FOREIGN PATENT DOCUMENTS 2302887 8/1974 Fed. Rep. of Germany .
2205630 5/1974 France .
1153580 5/1969 United Kingdom .
1445750 8/1976 United Kingdom .

*Primary Examiner*—Andres Kashnikow
*Assistant Examiner*—William Grant
*Attorney, Agent, or Firm*—Dvorak and Traub

[57] ABSTRACT

A residual pressure control valve which is interposed between a fuel injection pump and a nozzle includes an annular valve element which is biased by a spring into contact with a seating surrounding a port connected to the pump. Slidable in the valve element is a piston which is resiliently biased away from the seating. The piston has a groove communicating with the port and the valve element has a port which is uncovered to the groove upon movement of the piston relative to the valve element against the action of its resilient loading.

2 Claims, 2 Drawing Sheets

PRESSURE CONTROL VALVE

Figure 1:
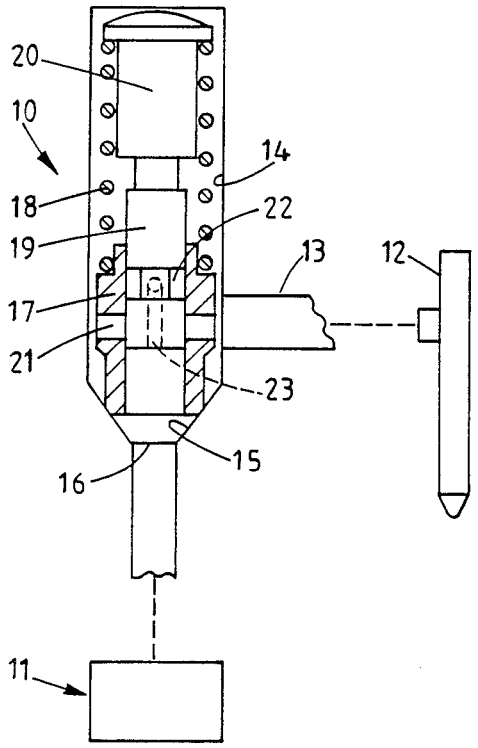

This invention relates to a residual pressure control valve for incorporation in the high pressure fuel conduit extending between the pumping chamber of a high pressure fuel injection pump and an injection nozzle of a compression ignition engine, the nozzle incorporarting a spring loaded fuel pressure actuated valve member.

British Patent Specification No. 1511122 describes various forms of such a valve and the valve shown in FIG. 8 comprises a hollow valve element which is biased into contact with an annular seating in one end wall of a cylinder by means of a coiled compression spring. Slidable within the valve element is a piston which extends from the valve element and is provided with a head. The head serves as an abutment for the spring and in the rest position of the valve with no pressure within the system, the head is engaged with the other end wall of the cylinder. The seating surrounds a port connected to the pumping chamber of the injection pump and the cylinder communicates with the inlet of the nozzle. In operation when fuel under pressure is delivered from the pumping chamber the valve element is lifted from the seating to allow fuel flow to the nozzle. When the flow of fuel from the pumping chamber ceases the valve element returns to its seating under the action of the spring and the valve of the nozzle closes. Some relief of the pressure in the conduit connecting the nozzle and the control valve will occur before the valve element closes and the pressure in the conduit will be further relieved by movement of the piston against the action of the spring. As the injection pressure is increased the stroke of the plunger will have to be increased in order to achieve a stable given residual pressure in the conduit. Increasing the stroke of the plunger besides requiring an increase in the volume of the cylinder which in itself is disadvantageous, also presents problems so far as the design of the spring is concerned.

The object of the invention is to provide a residual pressure control valve for the pumping system in a simple and convenient form.

According to the invention a residual pressure control valve for the purpose specified comprises in combination a cylinder having one end wall defining an annular seating surface about a port connected in use to the pumping chamber of the pump, an annular valve element movable in the cylinder, a spring biasing said valve element into contact with the seating surface, a piston slidable in a bore defined in said valve element, said piston being resiliently biased away from said one end wall of the cylinder, an outlet from said cylinder, said outlet in use being connected to said nozzle, and valve means defined by said valve element and said piston, said valve means being operable to connect said port with said outlet after a predetermined movement of the piston relative to the valve element against the action of its resilient loading.

Figure 2:
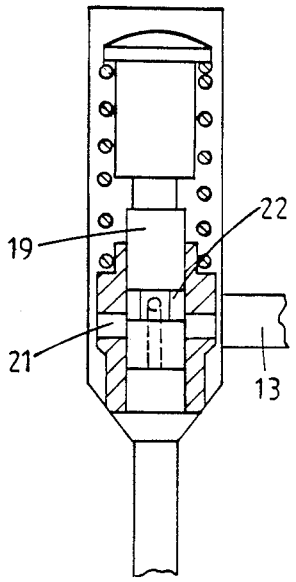
Figure 3:
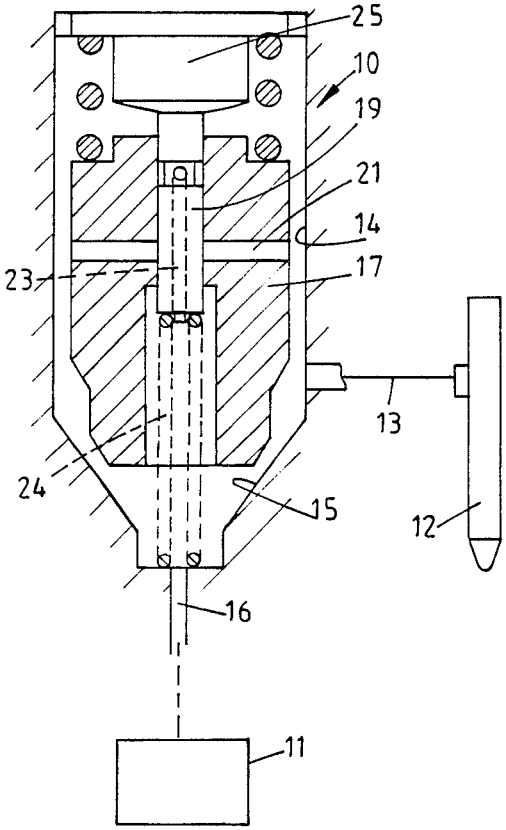
Figure 4:
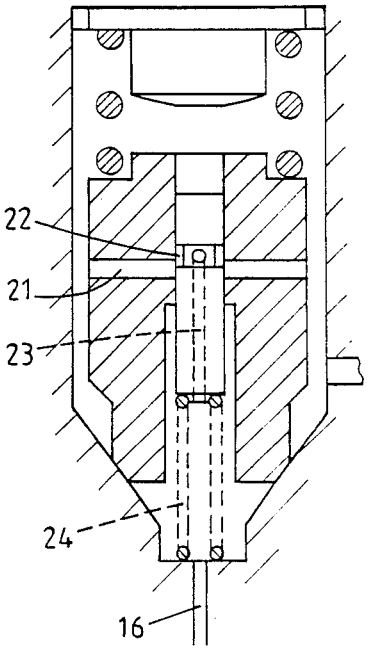

An example of a pressure control valve in accordance with the invention will now be described with reference to the accompanying drawings in which:

FIG. 1 is part sectional side elevation of the valve shown in the rest position and also illustrating the connection of the valve to the pumping chamber of an injection pump and to an injection nozzle, FIG. 2 shows the valve in the equilibrium position, and FIGS. 3 and 4 are similar to FIGS. 1 and 2 respectively but show a modified construction.

Referring to the drawings the residual pressure control valve generally indicated at 10, is connected between the pumping chamber of an injection pump 11 and a fuel injection nozzle 12 the valve in the particular instance being located in the body of the injection pump and being connected to the injection nozzle by way of a conduit 13.

The valve 10 comprises a cylinder 14 one end wall of which defines an annular seating 15 about a port 16 connected to the pumping chamber of the injection pump. Slidable within the cylinder is an annular valve element 17 one end of which is shaped for co-operation with the seating. The valve element defines a step for engagement by a coiled compression spring 18, the spring acting to urge the valve element into contact with the seating.

Slidable within the valve element is a piston 19 having a head 20 which defines a flange for engagement by the spring 18. The head has a domed end engageable with the other end wall of the cylinder opposite to that in which the port 16 is formed.

The conduit 13 is connected to a port formed in the side wall of the cylinder and in operation when fuel under pressure is delivered from the pumping chamber of the injection pump the valve element 17 is lifted from its seating to permit fuel flow through the conduit 13 to the injection nozzle, the spring 18 being compressed. When the delivery of fuel by the injection pump eases the valve element returns under the action of the spring 18 into contact with the seating 15 and before such sealing contact is established, a small quantity of fuel will return from the conduit 13 to the pumping chamber of the injection pump. When the valve element is in contact with the seating the pressure in the cylinder 14 which is equal to that in the conduit 13, acts upon the piston to move the piston downwardly and the piston will assume a piston with its domed end spaced from the other end wall of the cylinder. The pressure within the cylinder and the conduit depends upon the strength of the spring, the area of the piston and the pressure downstream of the valve. Thus the residual pressure in the conduit is controlled at a predetermined value. Where the injection pressure is extremely high the stroke of the piston would have to be increased to achieve the same residual pressure and as previously described, this can pose problems in the design of the valve. For example, whilst it is possible to increase the stroke of the piston this does necessitate a larger volume for the cylinder and it also increases the stress in the spring 18. Moreover, when the valve member in the injection nozzle closes pressure pulses will be transmitted along the conduit 13 towards the cylinder and they may be of sufficient magnitude to cause the piston to move downwardly against the action of the spring, such further movement substantially increasing the stress in the spring.

In order to avoid such additional movement, the valve element is provided with a plurality of ports 21 which during the movement of the piston against the action of the spring are uncovered to a groove 22 formed in the periphery of the piston and communicating by way of a central drilling 23, with the port 16. The arrangement is such that during the relative movement of the valve element and piston against the action of the spring, the groove 22 will move into register with the ports 21 to place the conduit 13 in communication with the port 16 by way of the drilling 23. The fuel returned from the conduit can therefore flow directly to the pumping chamber of the injection pump and when the pressure in the conduit has fallen by a sufficient amount, the piston will move upwardly under the action of the spring to the equilibrium position shown in FIG. 2 in which the ports 21 are just closed by the piston. Excessive movement of the piston is therefore prevented with a consequent reduction in the stress applied to the spring 18 and without the need to increase the stroke of the piston.

In the arrangement shown in FIGS. 3 and 4 identical reference numbers are used wherever possible to those of FIGS. 1 and 2. The main difference between the two constructions is that the piston 19 is provided with a separate spring 24 to bias it away from the end wall of the cylinder 14 from which extends the port 16. As a result the piston 19 is separate from a spring abutment 25 for the spring 18. The abutment 25 is engaged by the piston as shown in FIG. 3 to determine the extent of movement of the piston. As in the example of FIGS. 1 and 2 the piston is provided with a circumferential groove 22 which communicates with the port 16 by way of a central drilling 23. The mode of operation is exactly the same as previously described. This example has the advantage that the effective mass of the piston is reduced by the fact that it is not coupled to the abutment. Moreover, although two springs are employed in the design it is possible to choose springs appropriate to the delivery valve function and the unloading function.

I claim:

1. A residual pressure control valve for incorporation in the high pressure fuel conduit extending between the pumping chamber of a high pressure fuel injection pump and a fuel injection nozzle, the control valve comprising a cylinder having one end wall defining a seating surface about a port connected to the pump, an outlet from said cylinder connected to said nozzle, an annular valve element having a port, said valve element being movable in the cylinder, a spring biasing the valve element into contact with the seating surface, the valve element defining a bore, a piston slidable in said bore, said piston being resiliently biased by said spring away from said one end wall of the cylinder, valve means comprising a groove on said piston, and passage means connecting said groove with said port, said valve means being operable to connect said port with said outlet after a predetermined amount of the piston relative to the valve element against the action of its resilient loading.

2. A control valve according to claim 1 in which said piston is provided with a head and said spring is located between said head and the valve element.

* * * * *